US008884536B2

(12) United States Patent
Kitamura et al.

(10) Patent No.: US 8,884,536 B2
(45) Date of Patent: Nov. 11, 2014

(54) LIGHTING POWER SOURCE AND LUMINAIRE

(75) Inventors: Noriyuki Kitamura, Kanagawa-ken (JP); Hirokazu Otake, Kanagawa-ken (JP); Yuji Takahashi, Kanagawa-ken (JP)

(73) Assignee: Toshiba Lighting & Technology Corporation, Yokosuka-shi, Kanagawa-ken (JP)

( * ) Notice: Subject to any disclaimer, the term of this patent is extended or adjusted under 35 U.S.C. 154(b) by 186 days.

(21) Appl. No.: 13/608,177

(22) Filed: Sep. 10, 2012

(65) Prior Publication Data

US 2013/0119878 A1 May 16, 2013

(30) Foreign Application Priority Data

Nov. 10, 2011 (JP) ..... 2011-246591

(51) Int. Cl.
*H05B 37/00* (2006.01)
*H05B 33/08* (2006.01)

(52) U.S. Cl.
CPC ..... *H05B 33/0815* (2013.01)
USPC ..... 315/200 R; 315/224; 315/297

(58) Field of Classification Search
USPC ..... 315/200 R, 201, 219, 221, 224, 276, 315/283, 297, 307
See application file for complete search history.

(56) References Cited

U.S. PATENT DOCUMENTS

| | | | | |
|---|---|---|---|---|
| 6,057,651 | A | 5/2000 | Usami | |
| 8,222,832 | B2 * | 7/2012 | Zheng et al. | 315/291 |
| 8,436,550 | B2 * | 5/2013 | Maehara | 315/291 |
| 2007/0152604 | A1 * | 7/2007 | Tatsumi | 315/247 |
| 2007/0182347 | A1 | 8/2007 | Shteynberg et al. | |
| 2008/0224629 | A1 | 9/2008 | Melanson | |
| 2011/0121754 | A1 | 5/2011 | Shteynberg et al. | |

FOREIGN PATENT DOCUMENTS

| | | | |
|---|---|---|---|
| JP | 2011-119237 | A | 6/2011 |
| WO | 2010/011971 | A1 | 1/2010 |
| WO | 2011/008635 | A1 | 1/2011 |

OTHER PUBLICATIONS

Extended EP SR Mar. 5, 2013, EP Appln. 12183420-4.
EP Communication (Office Action) mailed May 13, 2014, EP Appln. 12183420.4.

* cited by examiner

*Primary Examiner* — Daniel D Chang
(74) *Attorney, Agent, or Firm* — Banner & Witcoff, Ltd.

(57) ABSTRACT

A lighting power source according to an embodiment includes a rectification circuit, a smoothing capacitor, a waveform shaping circuit, and a DC-DC converter. The rectification circuit rectifies an AC voltage input thereto. The waveform shaping circuit is connected between the rectification circuit and the smoothing capacitor, performs a switching operation to repeat an ON state and an OFF state when the voltage output from the rectification circuit is relatively high, continues to be in the ON state to allow the current to flow to the rectification circuit when the voltage output from the rectification circuit is relatively low. The DC-DC converter converts a voltage charged in the smoothing capacitor.

8 Claims, 3 Drawing Sheets

LIGHTING POWER SOURCE AND LUMINAIRE

CROSS-REFERENCE TO RELATED APPLICATIONS

This application is based upon and claims the benefit of priority from the prior Japanese Patent Application No. 2011-246591, filed on Nov. 10, 2011; the entire contents of which are incorporated herein by reference.

FIELD

Embodiments described herein relate to a lighting power source and a luminaire.

BACKGROUND

In recent years, replacement of lighting sources from incandescent lamps or fluorescent lamps to energy saving and long life lighting sources such as light-emitting diodes (LED) in luminaires is in progress. Also, for example, new lighting sources such as EL (Electro-Luminescence) or Organic light-emitting diode (OLED) are also developed. Since light outputs from such lighting sources depend on current values flowing therethrough, a power circuit configured to supply a constant current is required when lighting the luminaire. When dimming light, a current to be supplied is controlled. A two-wire dimmer is configured to control the phase which turns triac ON, and is in widespread use as a dimmer of the incandescent lamp. Therefore, the lighting source such as the LED is preferably dimmed by the dimmer. A switching power source such as a DC-DC converter is known as a power source having high efficiency and being suitable for electric power saving and downsizing.

However, the dimmer is configured to be connected in series with a filament of an incandescent lamp acting as a load to allow a current equal to or larger than a holding current required for the dimmer at all phases to flow, thereby operating. Therefore, when the switching power source is connected, a period during which a load impedance is changed and the holding current does not flow occurs, and hence a malfunction may be resulted.

DETAILED DESCRIPTION

Figure 1:
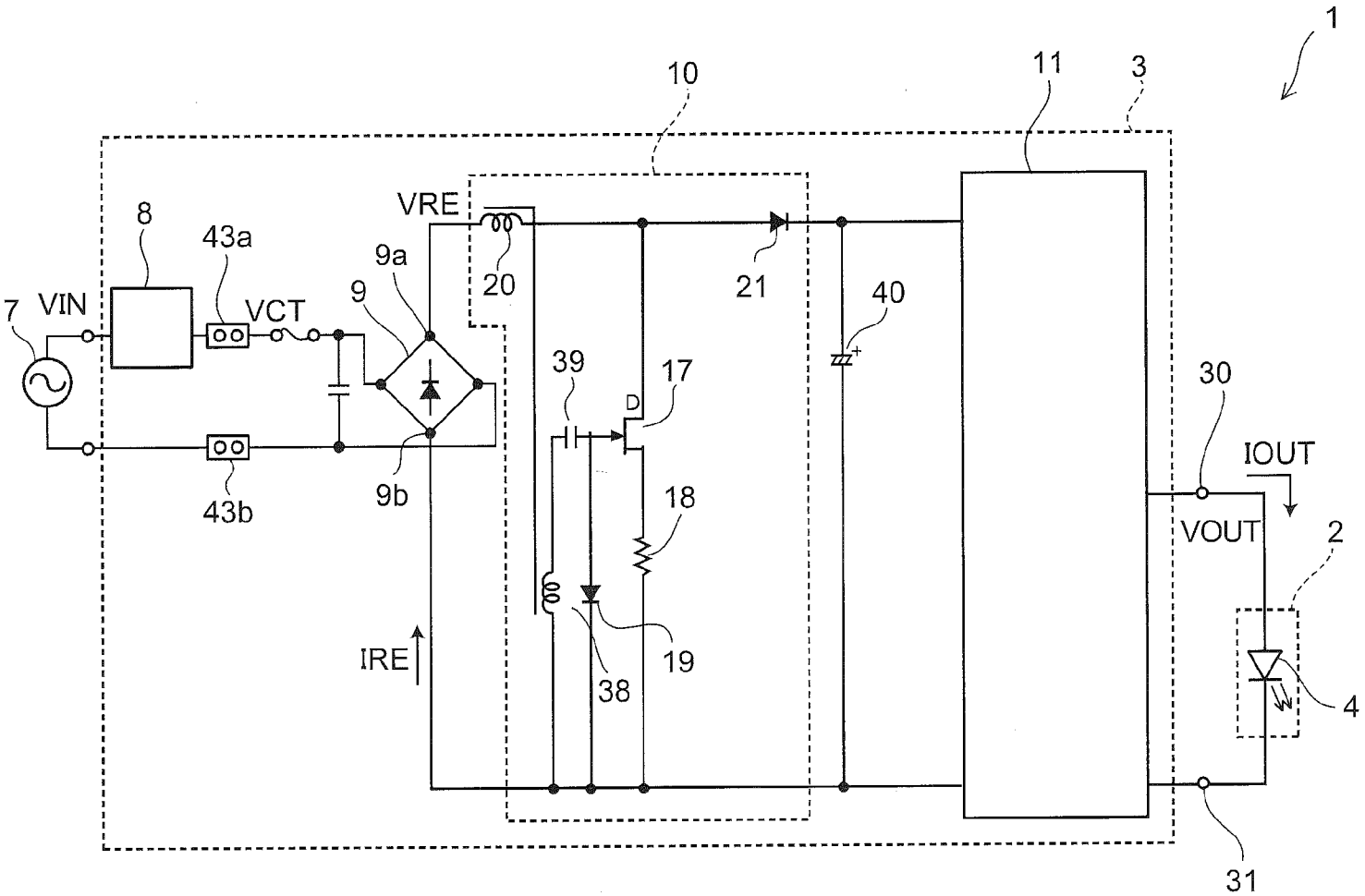
FIG. 1 is a circuit diagram illustrating a luminaire including a lighting power source according to a first embodiment.

A lighting power source according to one embodiment includes a rectification circuit, a smoothing capacitor, a waveform shaping circuit, and a DC-DC converter. The rectification circuit rectifies an AC voltage input thereto. The waveform shaping circuit is connected between the rectification circuit and the smoothing capacitor, performs a switching operation to repeat an ON state and an OFF state when the voltage output from the rectification circuit is relatively high, continues to be in the ON state to allow the current to flow through the rectification circuit when the voltage output from the rectification circuit is relatively low. The DC-DC converter converts a voltage charged in the smoothing capacitor.

Referring now to the drawings, embodiments will be described in detail. In this specification of the application and respective drawings, the same components as those described relating to already presented drawing are designated by the same reference numerals and detailed description will be omitted as needed.

A first embodiment will be described. FIG. 1 is a circuit diagram illustrating a luminaire including a lighting power source according to the first embodiment.

As illustrated in FIG. 1, a luminaire 1 includes a lighting load 2, and a lighting power source 3 configured to supply power to the lighting load 2.

The lighting load 2 includes a lighting source 4 such as an LED, and is turned ON by being supplied with an output voltage VOUT and an output current IOUT from the lighting power source 3. The lighting load 2 is capable of dimming light by varying at least either one of the output voltage VOUT or the output current IOUT. The values of the output voltage VOUT and the output current IOUT are defined in accordance with the lighting sources.

The lighting power source 3 is connected to a AC power source 7, and includes a dimmer 8 configured to control the phase of a AC voltage and control the timing of conduction, a rectification circuit 9 configured to rectifies the AC voltage controlled in phase, a waveform shaping circuit 10 configured to shape the current waveform flowing through the rectification circuit 9, a DC-DC converter 11 configured to generate the output voltage VOUT, and a smoothing capacitor 40. An AC power source 7 is, for example, a commercial power source.

The dimmer 8 is connected to the AC power source 7, and is inserted into one of a pair of power lines configured to supply power voltage VIN in series. The dimmer 8 may be inserted into the pair of power lines configured to supply the power voltage VIN in series.

Figure 2:
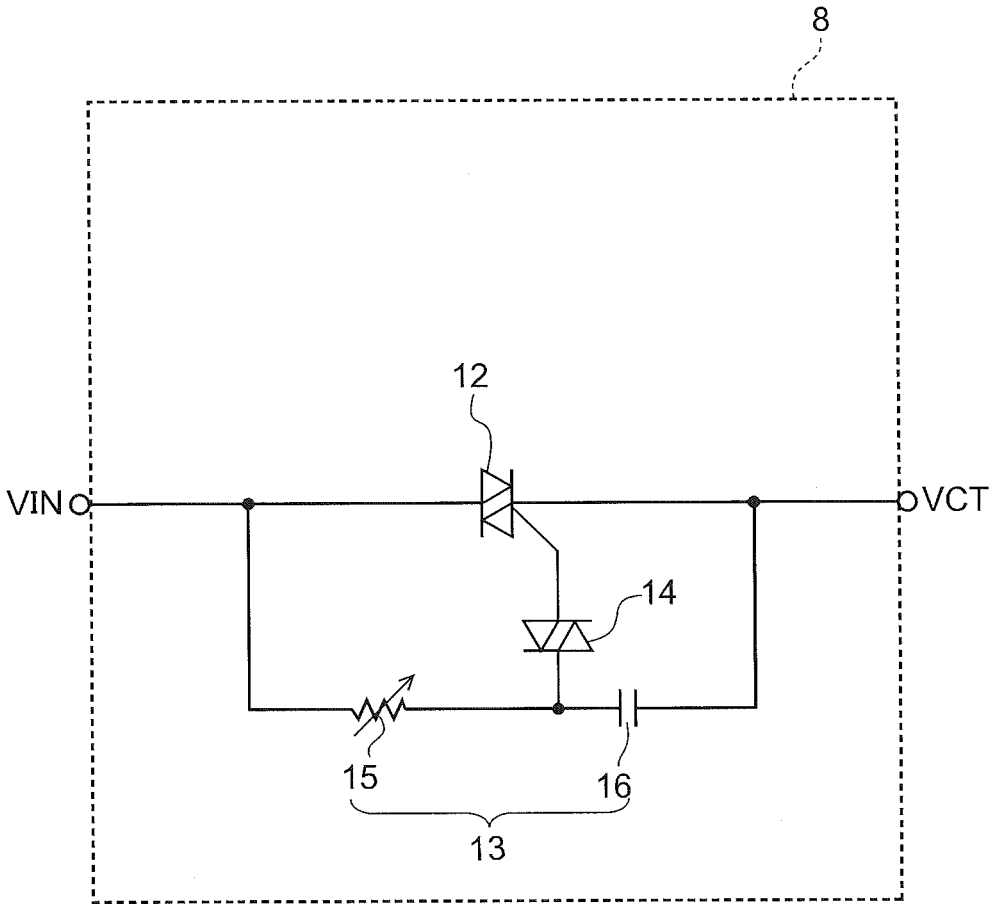
FIG. 2 is a circuit diagram illustrating a dimmer.

FIG. 2 is a circuit diagram illustrating a dimmer.

As illustrated in FIG. 2, the dimmer 8 is a two-wire phased control dimmer.

The dimmer 8 includes a triac 12 inserted into the power line in series, a phase circuit 13 connected in parallel to the triac 12, and a diac 14 connected between a gate of the triac 12 and the phase circuit 13.

The triac 12 is normally OFF state and is turned ON when a pulse signal is input to the gate. The triac 12 is capable of allowing a current to flow in both directions when the alternating power voltage VIN has either a positive polarity or a negative polarity.

The phase circuit 13 includes a variable resistance 15 and a capacitor 16, and generates a voltage delayed in phase at both ends of the capacitor 16. When the value of resistance of the variable resistance 15 is varied, a time constant varies and a delay time varies.

The diac 14 generates a pulse voltage when the voltage charged in the capacitor of the phase circuit 13 exceeds a certain value, and turns ON the triac 12.

The dimmer 8 is capable of adjusting timing when the triac 12 is turned ON by controlling the timing when the diac 14 generates pulses by varying the time constant of the phase circuit 13. The dimmer 8 outputs an AC voltage VCT which varies in timing of conduction depending on the dimming degree.

Returning back to FIG. 1 again, the rectification circuit rectifies the AC voltage VCT controlled in timing of conduction by the dimmer 8 and outputs a DC voltage (pulsed flow voltage) VRE. The rectification circuit 9 outputs the DC voltage VRE which varies in timing of conduction, that is, phase at which the voltage rises in accordance with the dimming degree of the dimmer 8. The rectification circuit 9 is composed of a diode bridge, and outputs the DC voltage VRE between a high-potential terminal 9*a* and a low-potential terminal 9*b*. The rectification circuit 9 may have any suitable configuration as long as the AC voltage input from the dimmer 8 is rectified. A capacitor which reduces a noise generated by the DC-DC converter is connected to an input side of the rectification circuit 9.

The waveform shaping circuit 10 includes a switching element 17, a resistance 18, diodes 19 and 21, a choke coil 20, a drive winding 38 magnetically coupled to the choke coil 20, and a capacitor 39.

The switching element 17 is, for example, a field-effect transistor (FET), and is, for example, a high-electron-mobility transistor (HEMT), and is a normally-on type element. A drain of the switching element 17 is connected to the high-potential terminal 9*a* of the rectification circuit 9 via the choke coil 20, and a source of the switching element 17 is connected to the low-potential terminal 9*b* of the rectification circuit 9 via the resistance 18. The gate (control terminal) of the switching element 17 is connected to one end of the drive winding 38 via the capacitor 39. The other end of the drive winding 38 is connected to the low-potential terminal 9*b* of the rectification circuit 9.

The drive winding 38 is connected to the gate of the switching element 17 at a polarity which supplies a voltage having a positive polarity to the source when a current increasing in the direction from the high-potential terminal 9*a* to the drain of the switching element 17 flows through the choke coil 20. The protecting diode 19 is also connected to the gate of the switching element 17.

An anode of the diode 21 is connected to the high-potential terminal 9*a* of the rectification circuit 9 via the choke coil 20, and a cathode of the diode 21 is connected to the DC-DC converter 11 and the smoothing capacitor 40.

The DC-DC converter 11 converts the voltage charged in the smoothing capacitor 40 and generates the output voltage VOUT.

Subsequently, the operation of the lighting power source 3 will be described.

The dimmer 8 outputs the AC voltage VCT which varies in timing of conduction, that is, phase at which the voltage rises in accordance with the dimming degree as described above. The AC voltage VCT rises at a phase 0 degree when the dimming degree is 100% to substantially the same level as the input power voltage VIN. When the dimming degree is reduced from 100%, the AC voltage VCT delays in phase of rising and, when the dimming degree is 0%, delays 180 degrees, that is, becomes approximately 0V. The dimming degree is a ratio of the output current IOUT with respect to the maximum current value, and is not proportional to the phase at which the AC voltage VCT rises.

The rectification circuit 9 outputs the DC voltage (pulsed flow voltage) VRE which is obtained by rectifying the AC voltage VCT output from the dimmer 8. Therefore, the DC voltage VRE output from the rectification circuit 9 is a voltage varying in value with time and varying in average value in accordance with the dimming degree.

Figure 3:
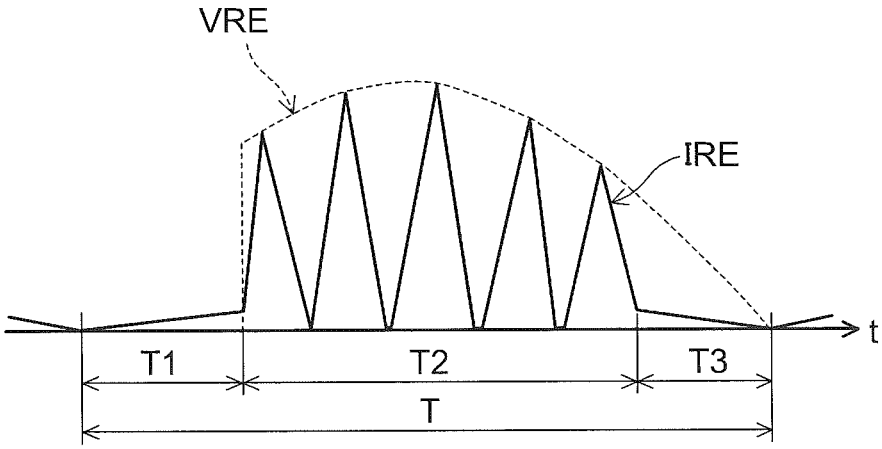
FIG. 3 is a waveform chart of a voltage VRE and a current IRE of a rectification circuit.

FIG. 3 is a waveform drawing of a voltage VRE and a current IRE of the rectification circuit.

As illustrated in FIG. 3, the rectification circuit 9 is controlled in phase by the dimmer 8, and outputs the voltage VRE (a broken line in FIG. 3) which rises the period T1 behind the zero cross of the power voltage VIN of the power source 7. The current IRE (a solid line in FIG. 3) of the rectification circuit 9 flows through the choke coil 20 without change.

When an instantaneous value of the DC voltage VRE input to the waveform shaping circuit 10 is relatively low, that is, is lower than the first voltage, which is the predetermined value (periods T1 and T3 in FIG. 3), the value of the current IRE flowing through the choke coil 20 is low, a current flowing through the resistance 18 is also small, and the voltage induced in the drive winding 38 magnetically coupled to the choke coil 20 is low. Consequently, the switching element 17 whose gate is supplied with the induced voltage from the drive winding 38 continues to be in the ON state. The switching element 17 allows a DC current to flow from the dimmer 8 via the choke coil 20 and the rectification circuit 9. The current value at this time is set to be larger than the current flowing through the phase circuit 13 of the dimmer 8, that is, the holding current.

When an instantaneous value of the DC voltage VRE input to the waveform shaping circuit 10 is relatively high, that is, equal to or higher than the first voltage as the predetermined value (period T2 in FIG. 3), the current IRE flowing through the choke coil 20 increases, the current flowing through the resistance 18 increases, and the source potential of the switching element 17 rises. A negative voltage exceeding a threshold voltage is generated between the gate and the source of the switching element 17. Consequently, the switching element 17 is turned OFF and the current IRE flowing through the choke coil 20 charges the smoothing capacitor 40 via the diode 21. At this time, the current IRE flowing through the choke coil 20 gradually reduces. When the current IRE flowing through the choke coil 20 becomes zero, the switching element 17 is turned ON. Consequently, a state in which the current flowing through the choke coil 20 is increased is restored, and the same operation is repeated from then onward. The switching element 17 performs a switching operation to repeat the ON state and the OFF state and oscillates.

Therefore, the switching element 17 allows an oscillation current to flow from the dimmer 8 via the choke coil 20 and the rectification circuit 9, and charges the smoothing capacitor 40 via the diode 21. The switching element 17 is a normally-on type element and is turned ON when the voltage induced by the drive winding 38 is lowered. Therefore, the current IRE continuously flows through the choke coil 20. Consequently, the current may be flowed continuously to the dimmer 8 via the rectification circuit 9.

In the period of half a cycle of the AC voltage VIN, that is, the time T between the zero crosses, the period T1 and T2 varies in accordance with the dimming degree of the dimmer 8.

Subsequently, the effect of the first embodiment will be described.

In this manner, in the first embodiment, when the instantaneous value of the voltage of the rectification circuit is relatively low, the ON state of the switching element of the waveform shaping circuit is continued to allow the DC current to flow. Consequently, even during the period when the dimmer is not in conduction, the holding current may be flowed through a phase circuit of the dimmer, and the control of the output current by the dimmer may be stabilized.

In the first embodiment, when the instantaneous value of the voltage of the rectification circuit is relatively high, the switching element of the waveform shaping circuit performs the switching operation to repeat the ON state and the OFF state. Consequently, power consumption caused by continuing the ON state may be inhibited to reduce the consumed power.

In the first embodiment, when the instantaneous value of the voltage of the rectification circuit is relatively low, the switching element does not perform the switching operation to repeat the ON state and the OFF state and continues to be in the ON state. Consequently, a problem of lowering of the power efficiency due to increase in the switching frequency with lowering of the voltage, and increase in switching loss does not occur. In addition, since a pause during which the current does not flow and which occurs in the case where the switching loss is limited by setting the maximum value of the switching frequency, does not occur, the control of the output current by the dimmer may be stabilized.

In the first embodiment, the waveform shaping circuit performs the switching operation to repeat the ON and the OFF state when the input voltage is relatively high and oscillates to allow an oscillating current to flow. Consequently, the average value of the current waveform supplied from the power source gets closer to the AC voltage waveform and hence improvement of power factor is achieved.

In addition, in the first embodiment, the waveform shaping circuit is a self-excitation type and has a simple circuit structure, so that downsizing is enabled.

Although the configuration in which the waveform shaping circuit has the normally-on type element has been described in the embodiment, a configuration having a normally-off type element is also applicable.

Figure 4:
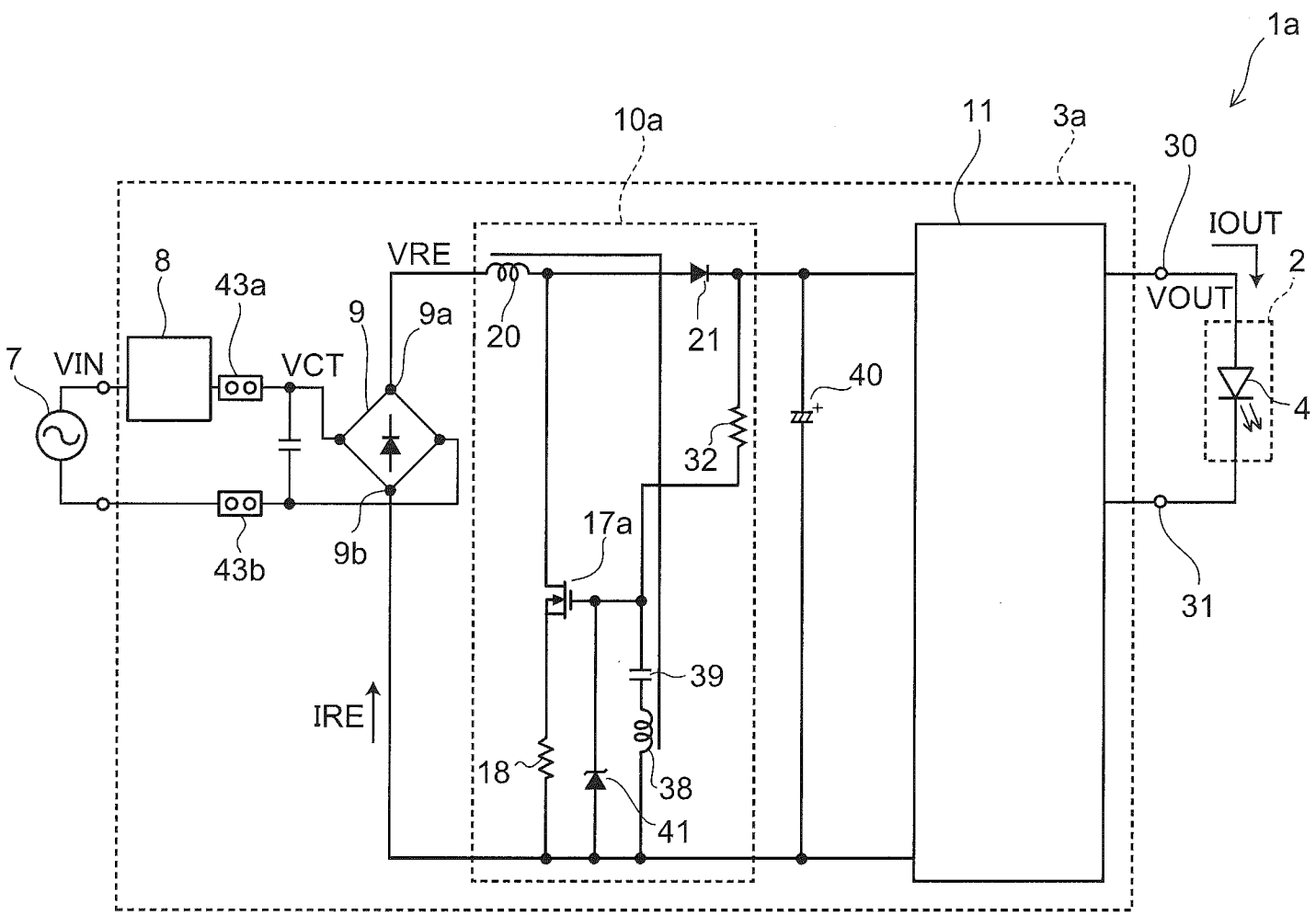
FIG. 4 is a circuit diagram illustrating a luminaire including a lighting power source according to a second embodiment.

FIG. 4 is a circuit diagram exemplifying a luminaire including a lighting power source according to a second embodiment.

As illustrated in FIG. 4, the second embodiment is different from the first embodiment in the configuration of the waveform shaping circuit 10. In other words, a lighting power source 3*a* includes the dimmer 8, the rectification circuit 9, a waveform shaping circuit 10*a*, and the DC-DC converter 11. The dimmer 8, the rectification circuit 9, and the DC-DC converter 11 are the same as those in the first embodiment. A luminaire 1*a* includes the lighting load 2 and the lighting power source 3*a*. The lighting load 2 is the same as that in the first embodiment.

The waveform shaping circuit 10*a* is different from the waveform shaping circuit 10 in the first embodiment in that the switching element 17*a* is a normally-off type element and in the configuration of a bias circuit. In other words, the waveform shaping circuit 10*a* includes a switching element 17*a*, the resistance 18, the choke coil 20, the diode 21, a bias resistance 32, the drive winding 38 magnetically coupled to the choke coil 20, the capacitor 39 and a Zener diode 41.

The switching element 17*a* is, for example, the FET and is a normally-off type element. A drain of the switching element 17*a* is connected to the high-potential terminal 9*a* of the rectification circuit 9 via the choke coil 20, and a source of the switching element 17*a* is connected to the low-potential terminal 9*b* of the rectification circuit 9 via the resistance 18. The gate of the switching element 17*a* is connected to one end of the drive winding 38 via the capacitor 39. The other end of the drive winding 38 is connected to the low-potential terminal 9*b* of the rectification circuit 9.

The drive winding 38 is connected to the gate of the switching element 17*a* at a polarity which supplies a voltage having a positive polarity to the source when a current increasing in the direction from the high-potential terminal 9*a* to the drain of the switching element 17 flows through the choke coil 20. An anode of the diode 21 is connected to the high-potential terminal 9*a* of the rectification circuit 9 via the choke coil 20, and a cathode of the diode 21 is connected to the DC-DC converter 11 and the smoothing capacitor 40.

The bias resistance 32 is connected between the cathode of the diode 21 and the gate of the switching element 17*a*, and the Zener diode 41 is connected between the gate of the switching element 17*a* and the low-potential terminal 9*b* of the rectification circuit 9. The switching element 17*a* is configured to be biased by the bias resistance 32 and the Zener diode 41 so as to be turned ON when the voltage is not induced in the drive winding 38.

Therefore, the operation and the effects of the waveform shaping circuit 10*a* are the same as those of the waveform shaping circuit 10 of the first embodiment in which the normally-on type element is used.

Although the embodiments have been described with reference to the detailed examples, the configurations are not limited to the embodiments, and various modifications are applicable.

For example, the lighting power source and the luminaire may not include the dimmer 8. In FIG. 1 and FIG. 4, the rectification circuit 9 is connected to the dimmer 8 via a connecting portion 43*a*, and connected to the AC power source 7 via a connecting portion 43*b*. However, a configuration in which the connecting portions 43*a* and 43*b* are connected to the AC power source 7 and the dimmer 8 is not included is also applicable. Alternatively, a structure in which the dimmer 8 is provided separately and the connecting portions 43*a* and 43*b* are configured to have the same structure as an input unit of the AC power source of the dimmer 8 in the case of including the dimmer 8 is also applicable. In this case, the lighting power source and the luminaire may be connected to the AC power source 7 with or without the intermediary of the dimmer 8.

The configuration of the waveform shaping circuit is not limited to those shown in FIG. 1 to FIG. 4. For example, a configuration in which two waveform shaping circuits are provided on the upstream side of the rectification circuit 9 and are operated every half-wave alternately.

The output elements 5*a* and 5*b* and the constant current elements 6*a* and 6*b* are not limited to GaN system HEMT. For example, a semiconductor element formed by using a semiconductor (wide band gap semiconductor) having a wide band gap such as Silicon Carbide (SiC), Gallium nitride (GaN), or diamond on a semiconductor substrate is also applicable. Here, the wide band gap semiconductor means a semiconductor having a wider band gap than gallium arsenide (GaAs) having a band gap of approximately 1.4 eV. Included are, for example, a semiconductor having a band gap of 1.5 eV or larger, gallium phosphide (GaP, a band gap of approximately 2.3 eV), gallium nitride (GaN, a band gap of approximately 3.4 eV), diamond (C, a band gap of approximately 5.27 eV), aluminum nitride (AlN, a band bap of approximately 5.9 eV), and silicon carbide (SiC). When equalization of the pressure resistances is wanted, such a wide band gap semiconductor element achieves a shorter switching frequency, and hence achieves downsizing of winding components or capacitors since a parasitic capacitance is small because the size may be reduced in comparison with a silicon semiconductor element and hence the high-speed operation is enabled.

The lighting source 4 is not limited to the LED, and an OLED are also applicable, and plural lighting sources 4 may be connected in series or in parallel to the lighting source 2.

Although several embodiments and the examples of the invention have been described these embodiments or the examples are presented as examples and are not intended to limit the scope of the invention. These novel embodiments or the examples may be implemented in other various modes, and various omissions, replacements, and modifications may be made without departing the scope of the invention. The embodiments or examples and the modifications are included in the scope and gist of the invention and included in the invention described in claims and in the scope which is equivalent thereto.

What is claimed is:

1. A lighting power source comprising:

a rectification circuit configured to rectify an input AC voltage;

a smoothing capacitor;

a waveform shaping circuit connected between the rectification circuit and the smoothing capacitor, configured to perform a switching operation to repeat an ON state and an OFF state when voltage output from the rectification circuit is relatively high, and configured to continue to be in the ON state to allow a current to flow to the rectification circuit when the voltage output from the rectification circuit is relatively low; and a DC-DC converter configured to convert a voltage charged in the smoothing capacitor, the waveform shaping circuit including:

a choke coil;

a switching element configured to allow a current to flow through the rectification circuit via the choke coil, the switching element being a normally-on type element, the switching element being controlled to the ON state or the OFF state on the basis of a current flowing through the choke coil; and a drive winding magnetically coupled to the choke coil, a voltage induced in the drive winding being supplied to a control terminal of the switching element, and the waveform shaping circuit being of a self-exciting type and being configured to continue the switching operation or the ON state.

2. The lighting power source according to claim 1, further comprising a dimmer configured to control a timing for conducting the AC voltage to dim light.

3. The lighting power source according to claim 2, wherein a value of the current flowed to the rectification circuit by the waveform shaping circuit continuously in the ON state is larger than a value of a holding current of the dimmer.

4. The lighting power source according to claim 1, wherein the waveform shaping circuit further includes a diode configured to allow a current to flow therethrough via the choke coil when the switching element is in the OFF state.

5. A luminaire comprising:

a lighting load; and a lighting power source configured to supply power to the lighting load and including:

a rectification circuit configured to rectify an input AC voltage;

a smoothing capacitor;

a waveform shaping circuit connected between the rectification circuit and the smoothing capacitor, configured to perform a switching operation to repeat an ON state and an OFF state when voltage output from the rectification circuit is relatively high, and configured to continue to be in the ON state to allow a current to flow to the rectification circuit when the voltage output from the rectification circuit is relatively low; and a DC-DC converter configured to convert a voltage charged in the smoothing capacitor, the waveform shaping circuit including:

a choke coil;

a switching element configured to allow a current to flow through the rectification circuit via the choke coil, the switching element being a normally-on type element, the switching element being controlled to the ON state or the OFF state on the basis of a current flowing through the choke coil; and a drive winding magnetically coupled to the choke coil, a voltage induced in the drive winding being supplied to a control terminal of the switching element, and the waveform shaping circuit being of a self-exciting type and being configured to continue the switching operation or the ON state.

6. The luminaire according to claim 5, further comprising a dimmer configured to control a timing for conducting the AC voltage to dim light.

7. The luminaire according to claim 6, wherein a value of the current flowed to the rectification circuit by the waveform shaping circuit continuously in the ON state is larger than a value of a holding current of the dimmer.

8. The luminaire according to claim 5, wherein the waveform shaping circuit further includes a diode configured to allow a current to flow therethrough via the choke coil when the switching element is in the OFF state.

* * * * *